United States Patent [19]

Linssen

[11] 3,970,890

[45] July 20, 1976

[54] PLURAL BEAM CATHODE RAY TUBE INCLUDING AN ASTIGMATIC ELECTRON LENS AND SELF-CONVERGING

[75] Inventor: Henricus Wilhelmus Maria Linssen, Eindhoven, Netherlands

[73] Assignee: U.S. Philips Corporation, New York, N.Y.

[22] Filed: Dec. 11, 1974

[21] Appl. No.: 531,693

[30] Foreign Application Priority Data

Jan. 23, 1974 Netherlands ..... 7400887

[52] U.S. Cl. ..... 313/413; 313/412

[51] Int. Cl.[2] ..... H01J 29/51; H01J 29/56

[58] Field of Search ..... 313/413, 414, 412

[56] References Cited

UNITED STATES PATENTS

| | | | |
|---|---|---|---|
| 2,834,901 | 5/1958 | Barkow et al. | 313/413 |
| 2,866,125 | 12/1958 | Haantjes et al. | 313/413 X |
| 3,603,839 | 9/1971 | Takayanagi | 313/414 X |
| B381,074 | 1/1975 | Hasker et al. | 313/414 X |

*Primary Examiner*—Robert Segal

*Attorney, Agent, or Firm*—Frank R. Trifari; George B. Berka

[57] ABSTRACT

A cathode ray tube having three electron guns in one plane which are deflected by a self-converging deflection coil. In order to obtain circular electron spots, the tube includes an astigmatic electron lens which restricts the dimension of the electron spots perpendicular to this one plane.

4 Claims, 3 Drawing Figures

Figure 1:
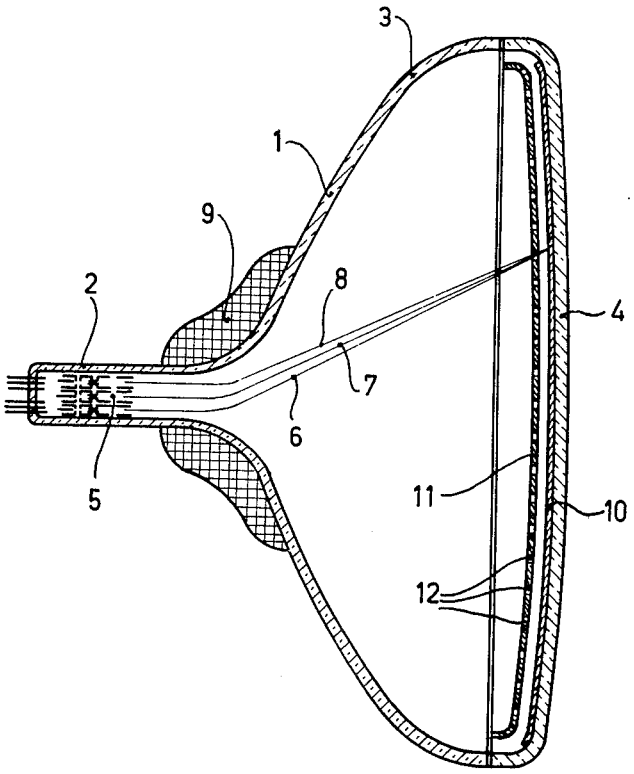

PLURAL BEAM CATHODE RAY TUBE INCLUDING AN ASTIGMATIC ELECTRON LENS AND SELF-CONVERGING

The invention relates to a cathode ray tube comprising means for generating three electron beams the axes of which are located substantially in one plane with the longitudinal axis of the tube, a display screen which extends substantially perpendicularly to the said longitudinal axis and on which the electron beams form three substantially coinciding electron spots, a first astigmatic deflection coil for deflecting the three electron beams in a first direction perpendicular to the said longitudinal axis and parallel to the said plane, and a second astigmatic deflection coil for deflecting the three electron beams in a second direction perpendicular to the said longitudinal axis and perpendicular to the said plane, of which first deflection coil the meredional image plane coincides substantially with the display screen and the sagittal image plane is located within the tube, and of which second deflection coil the sagittal image plane coincides substantially with the display screen and the meridional image plane is located within the tube.

Such a cathode ray tube with deflection coil is known from the United States Patent No. 2,866,125. In this specification it is described that a deflection coil does not only deflect an electron beam but also focuses it and that, by using an astigmatic deflection coil, the electron beam is not focused to a punctiform focus but to two mutually perpendicular linear foci which are present at some distance from each other. The image plane in which the linear focus is parallel to the deflection direction is termed the sagittal image plane and the image plane in which the linear focus is perpendicular to the deflection direction is termed the meridional image plane. By considering the three electron beams together as one flat ribbon shaped beam, the linear focus which the first and second deflection coil would form on the display screen degenerates to a point. In other words: the three electron spots of the individual electron beams remain converged in one point also upon deflection. This has the great advantage that extra measures to converge the electron beams during the deflection in one point, the so-called dynamic convergence means which are necessary in a tube with the electron beams in delta configuration, may be omitted.

A drawback of such a cathode ray tube, however, is that the deflection coils also focus the three electron beams each individually to a linear focus so that the three electron spots obtain a slightly elliptical shape the longitudinal direction of which is perpendicular to the said plane through the electron beams.

It is the object of the invention to avoid this drawback and to obtain dimensions of the three coinciding electron spots which are as small as possible.

According to the invention, a cathode ray tube of the kind mentioned in the first paragraph comprises means which form an astigmatic electron lens to restrict the dimension of the electron spots in the said second direction. Said astigmatic electron lens may serve either to restrict the dimension in the said econd direction of the electron beams upon passing through the deflection coils, or to compensate for the two strong focusing in the said second direction of the electron beams upon passing the deflection coils.

The means which form an astigmatic electron lens may comprise an astigmatic element which is arranged in an electrode of the means to generate the electron beams, for example, an elongate aperture in an electrode or a plate having a non-circular aperture which is provided in a cylindrical electrode.

The means which form an astigmatic electron lens may also comprise a magnetic quadrupole the axis of which coincides substantially with the central electron beam. Such a magnetic quadrupole may be formed with extra coils on the core of the deflection coil and may also consist of one or more permanent magnetic disks around the neck of the tube. The converging and diverging effects, respectively, which such a quadrupole exerts on each beam individually are associated with converging and diverging effects, respectively, on the three beams collectively. However, the last-mentioned effect may simply be taken into account by adapting the angle which the axes of the electron beams for the deflection enclose with each other.

Figure 2:
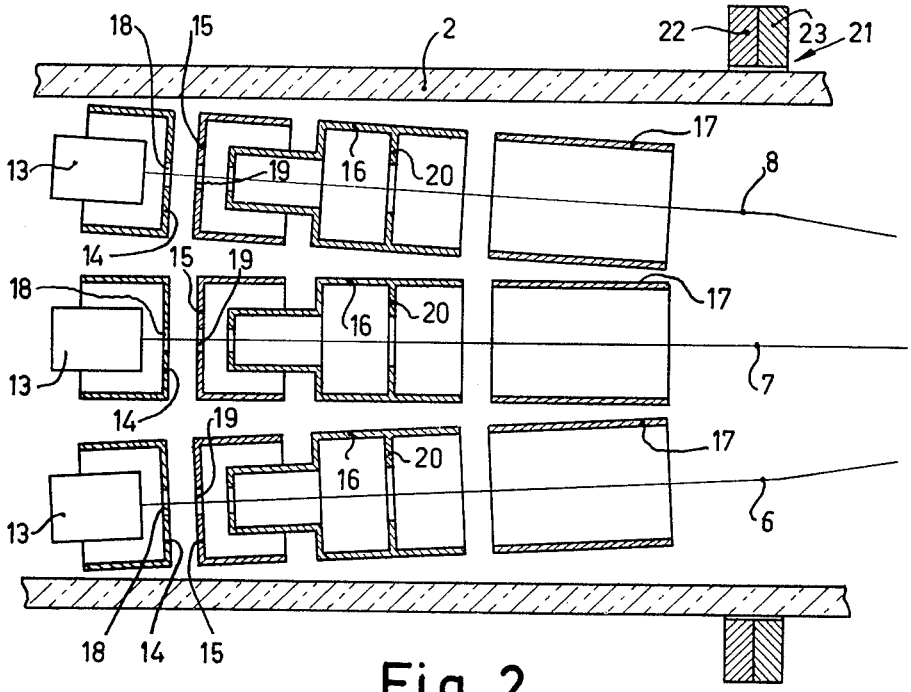
Figure 3:
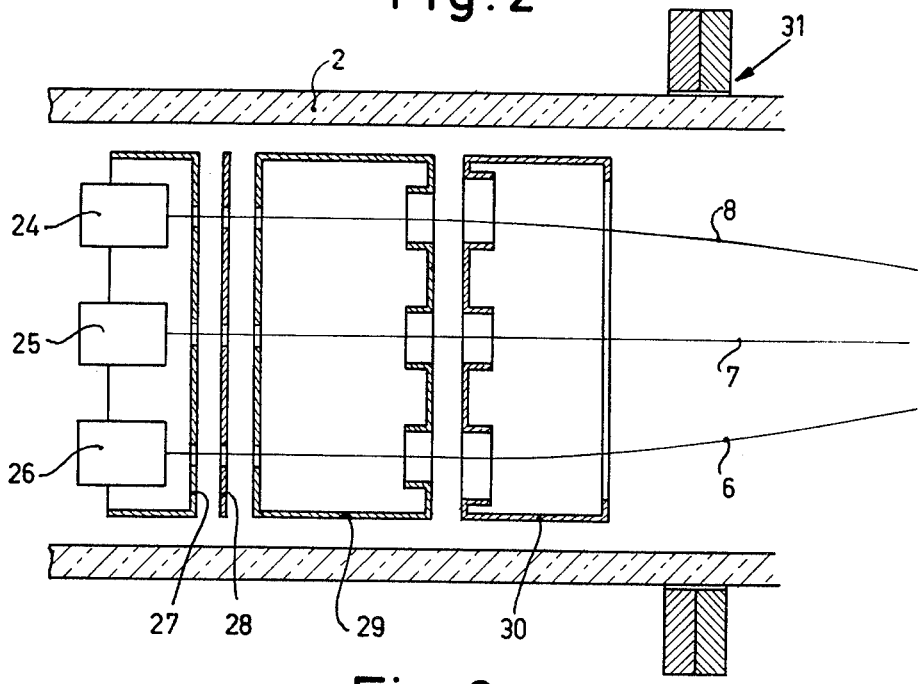

The invention will be described in greater detail with reference to the accompanying drawing, of which:

FIG. 1 shows a cathode ray tube for displaying coloured pictures according to the invention, FIG. 2 shows an electron gun for the tube shown in FIG. 1, FIG. 3 shows another embodiment of an electron gun for the tube shown in FIG. 1.

The cathode ray tube shown in FIG. 1 for displaying coloured pictures is of the shadow mask type. The tube comprises an evacuated envelope 1 consisting of a neck 2, a cone 3 and a face plate 4. Arranged in the neck 2 is an electron gun 5 which generates three electron beams 6, 7 and 8 which are deflected by the deflection coil 9 over a phosphor screen 10 present on the face plate 4. The said electron gun will be explained in greater detail with reference to FIGS. 2 and 3. In front of the phosphor screen 10 a shadow mask 11 is provided which has a large number of apertures 12. In known manner the electron beams 6, 7 and 8 are selected by the shadow mask in such manner that the electron beam 6 impinges only upon red luminescing phosphor regions of the screen 10 and the electron beams 7 and 8 impinge only upon green and blue luminescing regions, respectively. The electron beams 6, 7 and 8 are generated by the electron gun 5 with their axes in one plane, the plane of the drawing of the FIGS. 1, 2 and 3. The electron beams scan the phosphor screen under the influence of the deflection coils in such manner that a line raster is described the parallel lines of which are parallel to the plane of the drawing of FIG. 1. The phosphor regions are formed by phosphor strips the longitudinal direction of which is substantially perpendicular to the plane of the drawing of FIG. 1. The phosphor regions may also be formed by phosphor dots which are arranged in a hexagonal pattern. The deflection coils 9 are constructed so according to the already mentioned U.S. Pat. No. 2,866,125 that the convergence of the electron beams 6, 7 and 8 is maintained upon deflection over the screen 10. As already stated, such a deflection coil, however, also has the property that the target spots of the beams, 6, 7 and 8 are elongated perpendicularly to the plane of the drawing of FIG. 1. The electron gun 5 which will be described in detail with reference to FIGS. 2 and 3 is constructed so that said disadvantageous effect is compensated for.

The electron gun shown in FIG. 2 comprises three separate electron guns each comprising a cathode 13, a first grid 14 (control grid), a second grid 15, a third grid 16 and a fourth grid 17. The fourth grids 17 are at the same voltage as the shadow mask 11, the phosphor screen 10 and a conductive layer (not shown) on the inner wall of the cone 3. The apertures 18 in the first grids 14 are elongate and have a length perpendicular to the plane of the drawing of 0.9 mm and a width in the plane of the drawing of 0.5 mm. Furthermore, a plate 20 is arranged in the third grids 16 and has an elongate aperture with a length in the plane of the drawing of 7.6 mm and a width perpendicular to the plane of the drawing of 5 mm. The aperture 19 in the second grid 15 is circular and has a diameter of 0.9 mm. The aperture of the third grid 16 facing the side of the second grid 15 has a diameter of 2 mm. The largest diameter of the grids 16 and 17 is 7.6 mm. The grids 14, 15, 16 and 17 are at voltages of 0 volt; 500 volts; 4.4 kilovolts and 25 kilovolts, respectively. A permanent magnetic quadrupole 21 is arranged around the neck 2 and has two permanent magnetic rings 22 and 23 which are each magnetized cyclically north-south-north-south along their circumferences. In known manner, by rotating said two rings, the strength and the orientation of the resulting quadrupole field can be adjusted. The quadrupole 21 does not only influence the focusing of each individual electron beam 6, 7 and 8, but also their mutual convergence. This should be taken into account upon determining the angle which the axes of the electron guns enclose with each other.

The electron gun shown in FIG. 2 comprises, summarisingly, per generated electron beam three astigmatic electron lenses, namely the aperture 18 in the first grid 14, the plate 20 in the third grid 16 and the quadrupole 21. The plate 20 may also be provided in the fourth grid 17 and then has the same effect when it is rotated 90°. The best results are obtained with: only an elongate aperture in the first grid (A); or with such an aperture combined with a plate in the third grid (B); or combined with a quadrupole (C). Furthermore, good results are achieved with a plate having a rectangular aperture in the second grid (D). The last-mentioned plate is present in the cylindrical part of the second grid immediately beside the aperture 19; the rectangular aperture therein has a longitudinal direction in the plane of the drawing of 4.5 mm and a height perpendicular to the plane of the drawing of 2 mm.

The table below shows the result, expressed in dimensions of the electron spot, for the cases A, B, C and D, for non-deflected beam (centre) and for a beam deflected towards a corner of the display screen (corner), and for beam currents of 500 and 2500 μA. In the table, $x$ is the dimension in mm of the target in the plane of the drawing and $y$ is the dimension in mm perpendicular thereto, $x$ being generally horizontal and $y$ vertical.

| | center | | | | corner | | | |
|---|---|---|---|---|---|---|---|---|
| | 500 μA | | 2500 μA | | 500 μA | | 2500 μA | |
| | $x$ | $y$ | $x$ | $y$ | $x$ | $y$ | $x$ | $y$ |
| A | 0.7 | 2.5 | 2.0 | 4.8 | 2.0 | 3.1 | 5.0 | 4.0 |
| B | 0.7 | 2.4 | 1.9 | 4.2 | 2.8 | 3.7 | 5.0 | 4.0 |

-continued

| | center | | | | corner | | | |
|---|---|---|---|---|---|---|---|---|
| | 500 μA | | 2500 μA | | 500 μA | | 2500 μA | |
| | $x$ | $y$ | $x$ | $y$ | $x$ | $y$ | $x$ | $y$ |
| C | 0.8 | 2.4 | 2.1 | 4.3 | 2.1 | 4.1 | 5.2 | 4.8 |
| D | 1.3 | 1.5 | 3.5 | 3.5 | 3.4 | 3.6 | 8.0 | 6.0 |

FIG. 3 shows another construction of the electron gun 5. It is an integrated gun which generates three electron beams 6, 7 and 8 which are emitted by several cathodes 24, 25 and 26 and traverse a common first grid 27, second grid 28, third grid 29 and fourth grid 30. The apertures in the fourth grid 30 are arranged slightly eccentrically in known manner relative to the apertures in the third grid 29 so as to obtain convergence of the electron beams 6, 7 and 8. Said convergence is also influenced by the quadrupole 31 which is identical to the quadrupole 21 shown in FIG. 2. Such an electron gun is particularly suitable for use with a quadrupole in connection with the small manufacturing tolerances which ensure a good alignment with the quadrupole. Upon using elongate apertures in the first grid 27, the results achieved are furthermore approximately equivalent to those achieved with the electron gun shown in FIG. 2 for the cases A and C.

What is claimed is:

1. A cathode ray tube having means for generating three electron beams the axes of which are located substantially in one plane with the longitudinal axis of the tube, a display screen which extends substantially perpendicularly to the said longitudinal axis and on which the electron beams form three substantially coinciding electron spots, a first astigmatic deflection coil for deflecting the three electron beams in a first direction perpendicular to the said longitudinal axis and parallel to the said plane, and a second astigmatic deflection coil for deflecting the three electron beams in a second direction perpendicular to the said longitudinal axis and perpendicular to the said plane, of which first deflection coil the meridional image plane coincides substantially with the display screen and the sagittal image plane is located within the tube, and of which second deflection coil the sagittal image plane coincides substantially with the display screen and the meridional image plane is located within the tube comprising means which form an astigmatic electron lens to restrict the dimension of the electron spots in the said second direction, said means comprising a static magnetic quadrupole axis of which coincides substantially with the central electron beam.

2. A cathode ray tube as claimed in claim 1, wherein the means which form an astigmatic electron lens comprise an astigmatic lens which is arranged in an electrode of the means to generate the three electron beams.

3. A cathode ray tube as claimed in claim 2, wherein the said astigmatic element is formed by an elongate aperture in the said electrode.

4. A cathode ray tube as claimed in claim 2, wherein the said astigmatic element is formed by a plate having a non-circular aperture which is provided in a cylindrical electrode.

* * * * *